United States Patent [19]

Sendzimir

[11] Patent Number: 4,592,404

[45] Date of Patent: Jun. 3, 1986

[54] PROCESS AND APPARATUS FOR COMBINED STEEL MAKING AND SPRAY CASTING

[76] Inventor: Tadeusz Sendzimir, Weekeepeemee Rd., Woodbury, Conn. 06798

[21] Appl. No.: 709,070

[22] Filed: Mar. 7, 1985

Related U.S. Application Data

[63] Continuation-in-part of Ser. No. 532,208, Sep. 14, 1983, Pat. No. 4,512,384.

[51] Int. Cl.[4] ..... B22D 11/10

[52] U.S. Cl. ..... 164/46; 164/473

[58] Field of Search ..... 164/46, 473, 55.1, 56.1, 164/57.1, 58.1; 264/5–8; 425/8; 266/215, 216; 75/0.5 C, 53, 56

[56] References Cited

U.S. PATENT DOCUMENTS

| | | | |
|---|---|---|---|
| 1,662,008 | 3/1928 | Legate | 164/46 X |
| 2,307,939 | 1/1943 | Merle | 164/46 X |
| 2,382,432 | 8/1945 | McManus et al. | 75/0.5 C |
| 2,639,490 | 5/1953 | Brennan | 164/427 X |
| 2,762,093 | 9/1956 | Hood | 164/46 |
| 2,864,137 | 12/1958 | Brennan | 164/429 X |
| 3,532,775 | 9/1966 | Brondyke et al. | 75/0.5 C X |
| 3,670,400 | 6/1972 | Singer | 164/479 X |
| 4,114,251 | 9/1978 | Southern et al. | 164/46 X |
| 4,419,060 | 12/1983 | Speier et al. | 264/8 X |
| 4,512,384 | 4/1985 | Sendzimir | 164/46 |

FOREIGN PATENT DOCUMENTS

| | | | |
|---|---|---|---|
| 2321847 | 11/1974 | Fed. Rep. of Germany | 164/473 |
| 2528843 | 1/1976 | Fed. Rep. of Germany | 164/46 |
| 58-73715 | 5/1983 | Japan | 75/56 |
| 511995 | 6/1976 | U.S.S.R. | 164/46 |

*Primary Examiner*—Kuang Y. Lin

*Attorney, Agent, or Firm*—Frost & Jacobs

[57] ABSTRACT

A process and apparatus for converting a stream of desilized and desulfurized pig iron into steel plates of unlimited length. A spray caster is employed utilizing a substantially cylindrical heat-absorbing target surface and a projector rotatable about a vertical axis substantially co-axial with the axis of the cylindrical target surface. A non-oxidizing atmosphere is maintained about the projector and within the space surrounded by the target surface. A pulverulent oxide, chosen from the class consisting of mill scale, iron oxide, the oxide of an alkaline metal which completely evaporates at the temperature of the molten pig iron, the oxide of a desired alloying metal and combinations thereof, is injected into the molten stream of pig iron. The molten stream of pig iron is caused to flow vertically upon the projector, as the projector is rapidly rotated. The projector converts the molten metal stream into a stream of particles having a solid, plastic state and projects the stream of particles against the target with such kinetic energy that the stream of particles impinge upon and become welded to similar particles previously projected against the target surface to build up the steel plate. The steel plate is continuously withdrawn from the target surface.

5 Claims, 6 Drawing Figures

PROCESS AND APPARATUS FOR COMBINED STEEL MAKING AND SPRAY CASTING

REFERENCE TO RELATED APPLICATION

The present application is a continuation-in-part of co-pending application Ser. No. 06/532,208, filed Sept. 14, 1983 in the name of Tadeusz Sendzimir and entitled: CONTINUOUS SPRAY CASTING, now U.S. Pat. No. 4,512,384.

TECHNICAL FIELD

The invention relates to a process and apparatus for combined steel making and spray casting, and more particularly to such a process and apparatus wherein molten pig iron, after removal of sulfur and silicon, is passed through an atomizer under non-oxidizing conditions, together with measured quantities of iron oxide and is sprayed against a target surface to produce a continuous slab or plate of steel having the desired carbon content. Measured quantities of other alloying elements may be added during the spray casting process to produce alloy steel.

DISCLOSURE OF THE INVENTION

The present invention comprises an improvement over known processes and apparatus for continuous casting. According to the present invention a molten metal such as pig iron is atomized under non-oxidizing conditions and projected at high velocity against a suitable, substantially cylindrical target. The distance to the target is such that the atomized particles partially solidify on their way and are welded by their kinetic energy to particles already deposited on the target.

Applicant has developed apparatus and a method to adapt such a process to continuous operation, and more particularly to production of wide slabs of great length and relatively small thickness (say, typically a 1.5"×60" section) and achieving this at great speeds of operation (such as 100–500 tons per hour), which speeds make it possible to place the apparatus upstream of a continuous hot strip mil and thus produce, say, 0.060"×60" strips in one continuous operation, from molten metal. Such mills cannot maintain their thermal balance if the speed of the workpiece is too slow.

Another feature of the process of the present invention lies in the fact that it lends itself to easy recouperation of the heat of fusion of the metal and of a substantial part of the heat contained in the product.

By combining the action of a few elements, applicant has obtained rather unexpected results that not only assure industrial production of plates and other flat products, but permit such production on a scale surpassing, by far, existing industrial processes. This is accomplished by the following:

1. Providing an atomizer or projector so shaped as to admit three to four times the quantity of gas needed for atomizing, while creating sufficient turbulance for the excess gas to absorb heat from the metal particles so that at least half of them reach the substantially cylindrical target in a partially solid, though still fluid state. Since the function of this device is primarily to project particles of molten metal at high kinetic energy, the device will hereinafter be referred to as a projector, both in the specification and in the claims.

2. Means are provided to rotate the projector at speeds over 6,000 r.p.m.

3. The centrifugal force acting on the metallic particles at such speed, aided by the current of cooling gas from the projector, has enabled the placement of the substantially cylindrical target at a considerable distance from the projector. The substantially cylindrical target may have a diameter of from about 75 feet to about 100 feet, which gives the metal particles a colossal area of contact with the target to absorb the remaining melting heat in the metal and even to lower its temperature somewhat.

4. By enclosing the umbrella of projected metallic particles between heat-absorbing roof and floor means, to form a substantially gas-tight chamber for the non-oxidizing gas, cooling of the metallic particles by radiation is increased. Furthermore, the projector, itself, is made to oscillate vertical by several inches or more (always within the space between the roof and floor means of the substantially gas-tight chamber). This step also increases by several times the area of the target.

5. Means are also provided for an almost total recouperation of the heat of the molten metal.

By fairly accurate calculation, such a continuous spray caster of the present invention utilizing a 75' diameter target, has ample capacity to produce 500 tons per hour, which is about 3,000,000 tons a year. This compares very favorably to a maximum through put of about 100 tons per hour for a 10"×60" section metallic product produced by conventional continuous casting. This is enough for many steel works to constitute the only caster for the general mix of flat products, from plates and tubes, through autobody and other sheets, down to tinplates. The cost of a unit of the present invention is considerably less than the cost of two or three conventional units required to achieve the same tonnage.

The product of the present invention comprises a homogeneous, small-grained, substantially non-porous metal structure which is characteristic of spray casting and which is completely free of segregations which are unavoidable with conventional continuous casting.

It has further been found that the process and apparatus of the present invention can be used to produce steel directly from the raw iron produced by a blast furnace, enabling the elimination of conventional steel-making operations, altogether, and resulting in substantial cost reductions. A blast furnace conventionally reduces iron ore to metallic iron, adding about 5% carbon. The raw iron obtained from the blast furnace is frequently referred to as "pig iron" or "cast iron". For purposes of clarity and consistency, the term "pig iron" will be used herein and in the claims which follow.

For steel qualities requiring a steel of less exacting analysis, such as rebars, the blast furnace pig iron is conventionally treated for removal of sulfur and silicon prior to the practice of the present invention. For steel qualities requiring a steel of more exacting analysis, such as steel for automotive or appliance uses, additional conventional purification steps may be employed with respect to the pig iron, prior to the practice of the present invention.

The appropriately purified pig iron is passed through the projector of the present invention, together with measured quantities of iron oxide which may be mill scale or refined iron ore which is reduced to iron after the particles reach the target, by combining with the carbon of which the pig iron may have from about 3% to about 5%. The quantity of the iron oxide which is added must be calculated to leave some excess carbon to produce steel with the desired final carbon content, for example less than about 0.2% (low carbon steel), from about 0.2% to about 0.5% (medium carbon steel), and above about 0.5% (high carbon steel).

In the practice of the present invention, alloying elements such as Ni, Mo, Va, and Cr may be added to alloy with the steel. Measured quantities of such metals in powder form are injected together with the steel. If the percentage of alloying elements is high, the steel should be sufficiently superheated.

DISCLOSURE OF THE INVENTION

According to the invention there is provided both a process and apparatus for converting a stream of desilicized and desulfurized molten pig iron into steel slabs or plates of unlimited length. A vertical stream of molten pig iron has injected into it a pulverulent substance containing oxygen such as iron oxide, an oxide of an alkaline metal which will completely evaporate at the temperature of the molten pig iron, or the oxide of a metal which is itself desirable as an alloy. The stream is thereafter caused to fall upon a projector rapidly rotating about a vertical axis and disposed in the center of a substantially cylindrical heat-absorbing target. The space surrounded by the substantially cylindrical target is filled with a non-oxidizing atmosphere such as dry nitrogen. At least half of the particles are partially solidified, although still fluid, when they hit the target surface. The particles hit the target surface with such kinetic energy that they impinge upon and become welded to similar particles that were previously projected onto the target surface. The target is rotated about a vertical axis and the product formed thereon is withdrawn therefrom as a single strip-like slab or plate.

The pulverulent material added to the molten pig iron stream is located in an annular container surrounding the stream or a plurality of containers arranged radially about the stream. Each container is provided with one or more means for metering the pulverulent material into the pig iron stream. When more than one pulverulent material is added to the stream, each pulverulent material may be located in an annular container surrounding the stream and provided with metering means, the annular containers being located one above the other.

DETAILED DESCRIPTION OF THE INVENTION

The above noted U.S. Pat. No. 4,512,384, of which this application is a continuation-in-part, teaches two embodiments of large scale spray caster. The teachings of the present invention can be applied to and practiced with either of these spray caster embodiments. For purposes of an exemplary showing, the present invention will be described in its application to that one of the spray caster embodiments utilizing a heavy gauge metal belt, having a flight arranged in a substantially cylindrical configuration and serving as the target against which the product of the present invention is made. No limitation is intended or should be inferred from this choice of an exemplary spray caster.

Figure 1:
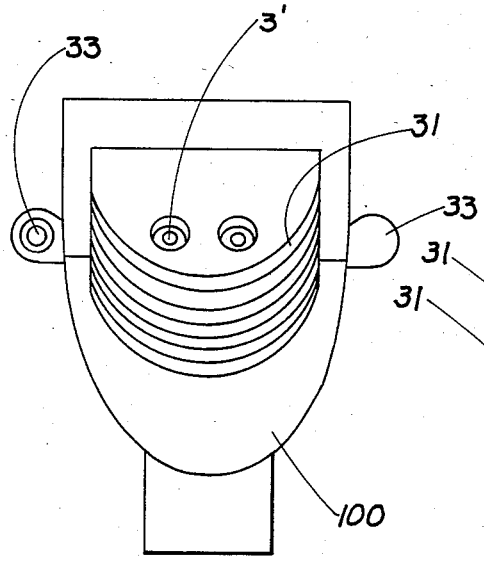
FIG. 1 is a front elevational view of the projector.
Figure 2:
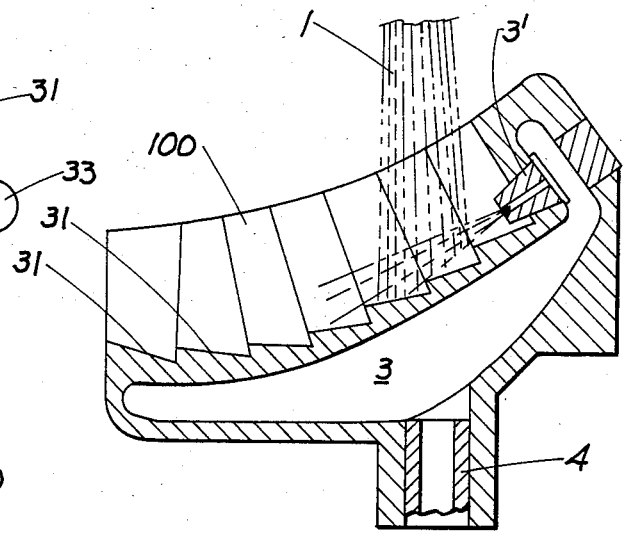
FIG. 2 is a longitudinal cross-sectional view of the projector of FIG. 1.

First of all, however, reference is made to FIGS. 1 and 2, constituting a front elevational view and a longitudinal cross-sectional view, respectively, of the high-speed rotary projector 100 (also shown in FIG. 4) for molten steel. The sawtooth-section spoon-form internal cavity 31 of the projector 100 is very deep. This is needed to impart to the particles the tremendous acceleration by centrifugal force permitting them to reach their target in about the order of one-tenth of a second. High pressure non-oxidizing gas such as dry nitrogen, in excess quantity over and above the needs for atomization, is admitted through the hollow shaft 4, first into chamber 3, to cool the spoon-form cavity. The gas thereafter enters the spoon-form cavity through at least two downwardly inclined nozzles 3', where the gas rushes in the form of a turbulent flowstream sweeping past the teeth of the cavity (increasing the turbulence) with such force that the stream of molten metal 1, descending vertically from a tundish (not shown), is first declined and substantially never touches the projector teeth, to be finally atomized by the turbulent stream of gas and projected by it, jointly with the centrifugal force created by the fast rotation of said projector, almost horizontally toward the ring form target in whose axis it rotates.

While the projector may be rotated by any appropriate means, including an air motor or the like, the embodiment shown is illustrated as being provided with a pair of horizontal nozzles 33, attached about midway of the projector and pointed in opposite directions. The nozzles are in communication with chamber 3 and cause the projector to work like a reaction turban, to make the projector rotate at a speed depending upon the gas pressure.

The sawtoothed interior 31 is ceramic-coated to prevent metal droplets from accidentally sticking to it.

The projector 100 projects the metal droplets at a high velocity against the non-sticking, heat-absorbing target, while causing them to lose heat under way, so that at least half of the droplets are partially solidified, though still fluid, when hitting the target. The projector causes the stream of projected particles to be swept rapidly across the target, so as to deposit upon the target a layer substantially only one particle deep at each passage, so as to cause even those particles which may have reached the target while still in molten state, to reach a crystallizing stage before the next passage of the stream.

Figure 3:
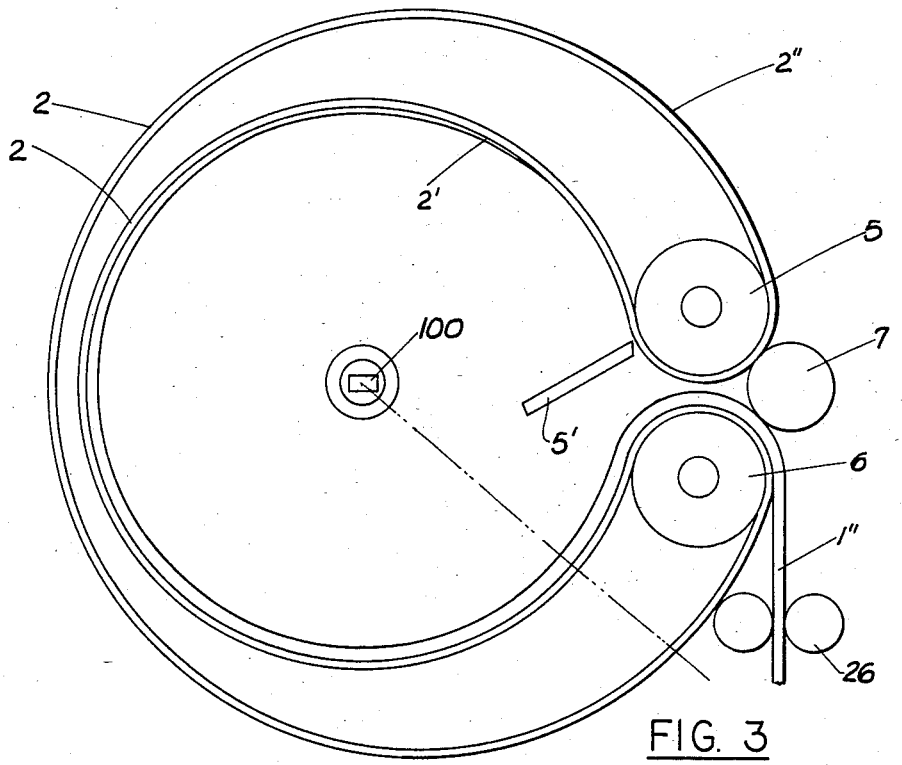
FIG. 3 is a semi-diagrammatic, simplified, plan view of an exemplary spray caster.
Figure 4:
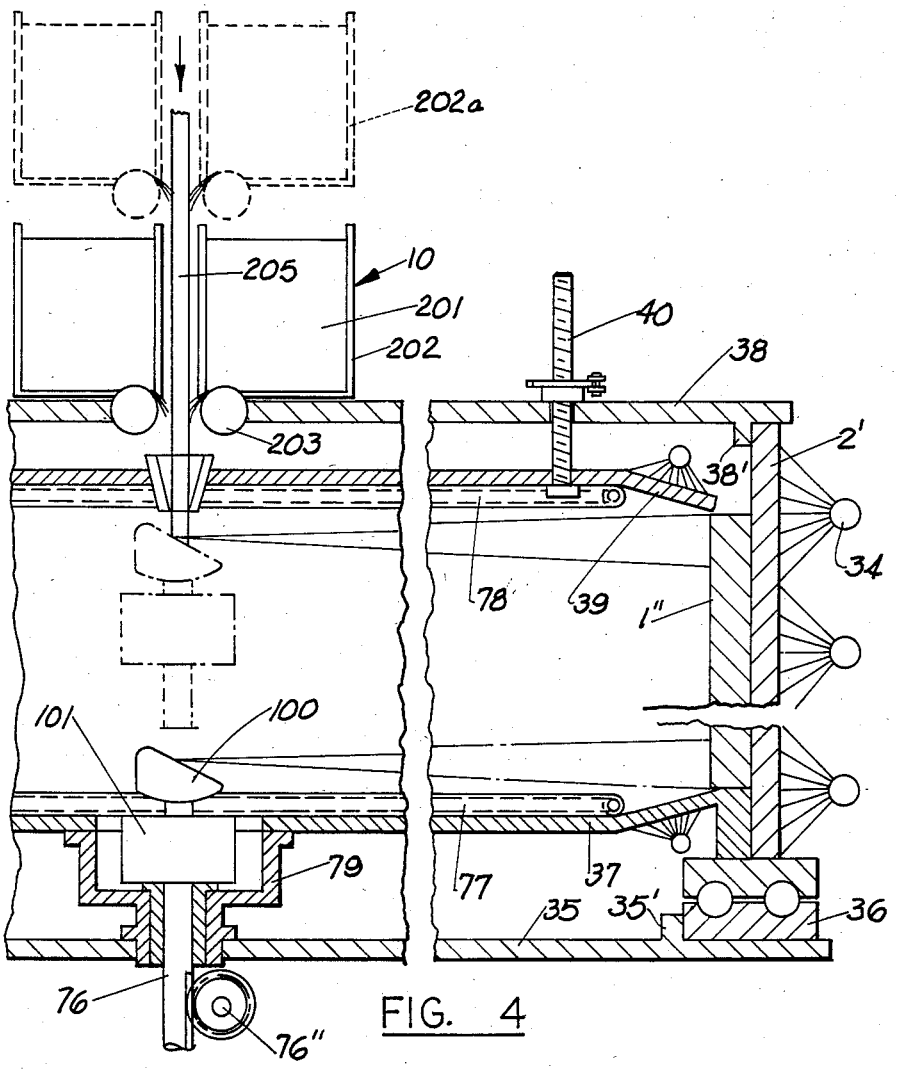
FIG. 4 is a fragmentary, vertical, cross-sectional view of the spray caster of FIG. 3 and is shown in greater detail and equipped with a pulverulent material dispenser.

FIGS. 3 and 4 show a simplified embodiment of the spray caster, as described in the above-noted parent application. In this embodiment, a central projector 100 is employed, and distribution of the atomized particle (over the whole width of the plate being produced) relies solely upon the vertical oscillation up and down of the projector. The cylindrical target is formed by a heavy-gauge continuous metallic belt 2. As best shown in FIG. 3, the belt 2 has a flight 2' constituting the substantially cylindrical, heat-absorbing target. On its return trip over the tangential exit pulley 6, the belt can describe any suitable path such as the circular flight 2''.

Thereafter the belt passes about the entry pulley 5 to form the target flight 2'. The target belt conveyor 2 is slightly wider than the maximum plate width (say, 6½ feet for a six-foot wide plate).

For guiding the target flight 2' of belt 2, the bottom edge of the belt is supported by the upper race of a ballbearing track-race 36 which is concentric with the target flight 2'. The bottom edge of the target flight 2' of belt 2 is maintained by tension in contact with the concentric circular edge of bottom plate 37, mounted on race 36. A loose circular cover 38 similarly guides the upper edge of target flight 2'. The cover 38 holds a gas-tight roof 39 of the atomizing chamber, the roof 39 being hung from the cover 38 on height-adjustable jacks 40, for controlling the width of the product of 1". A ballbearing track (not shown), similar to track race 36, is provided to guide the return flight 2" of the belt during its outside return trip. The bottom plate 37 of the chamber is gas-tight and is not adjustable with respect to height. The outer peripheral portions of gas-tight roof 39 and gas-tight bottom plate 37 are at a slight angle to the horizontal, so as to deflect any atomized particles that may hit them, back upon the target. Roof 39 and bottom plate 37 are also provided with heat-absorbing means, such as boiler tubes 77, through which steam or water is circulated.

The projector 100 is affixed to the upper end of a stem 76 which is slidably located in bearings provided in the structure 79 at the axis of the instrumentality. Pneumatic actuator 76", located in the same structure 79, is provided to oscillate the projector 100 up and down over a rack and pinion or equivalent gearing. The projector 100 is shown in its lowest position in solid lines and in its highest position in broken lines.

As explained above, the oscillations are rapid so as to deposit only a very thin layer of projected particles at each passage and the velocity is automatically controlled to correct any difference in thickness of the plate across its width. Thickness differences lengthwise of the plate are correct by controlling the speed of pinch rolls 26 which extract the plate product 1", because the thickness of the plate increases gradually as it is being built-up upon the target belt flight 2' from the entry pulley 5 to the exit pulley 6.

A ceramically coated deflector plate 5' is provided opposite the spot where the two pulleys 5 and 6 meet to prevent any projected particles from being thrown between the pulleys 5 and 6.

The outside surface of the inner cylindrical target belt flight 2' is cooled by closely spaced sprays 34. Nevertheless, the thickness of the belt 2, itself, must be substantial so as to avoid local overheating (say ⅜ to ½ inch). When steel belts are used and prove to be short-lived owing to the rapid temperature changes, a much longer endless belt may be provided and the belt may deviate from the outer return flight 2" and into a double spiral coil accumulator (such as disclosed in U.S. Pat. No. 3,310,255) and back again to complete the belt. This permits avoidance of frequent belt changes.

The exit pulley 6 is preferably driven, since it reverse-bends the product plate 1" and this requires most of the energy consumed, especially when the product plate 1" is heavy. Loose roll 7, pressed against the exiting plate passing about the exit pulley 6 and against the endless belt 2 on the entry pulley 5, also serves the purpose of producing a gas-tight seal.

Figure 5:
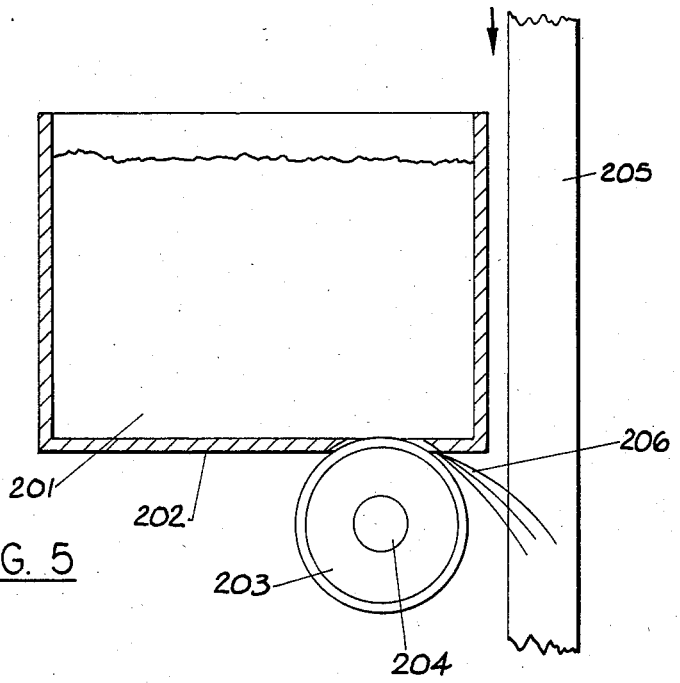
FIG. 5 is a fragmentary, cross-sectional, elevational view of a pulverulent material dispenser.
Figure 6:
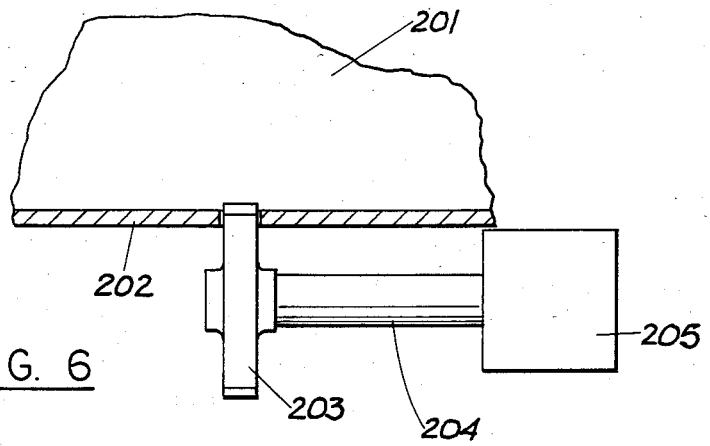
FIG. 6 is a fragmentary, front elevational view of the dispenser of FIG. 5.

FIGS. 4, 5 and 6 illustrate additional specific apparatus required to implement the steel-making process of the present invention. In order to obtain a homogeneous mixture, iron oxide powder and other ingredients (if used) must be blown-in, or injected into the stream of molten pig iron from several sources evenly disposed around it. Since the iron-oxygen-carbon reactions are instantaneous, the molten mixture becomes steel immediately. Low carbon steel has a melting temperature about 300° C. higher than pig iron. Therefore, the particles projected against the target arrive in a partially solidified, still fluid state and, because of the high kinetic energy of impact, become united by welding with the previously deposited layer.

An exemplary apparatus for injecting the pulverulent material into a stream of molten pig iron is illustrated in FIGS. 4, 5 and 6 in the form of an annular dispensing receptacle 202 containing metal oxide powder 201. The dispensing receptacle is situated axially on top of the cover 38 of the main spray-casting instrumentality. The stream of molten pig iron 205 is also axially located and is in position to receive injections of metallic oxide powders 201 by means of several dispensing and projecting devices comprising toothed wheels 203 having a sliding fit in slots in the dispensing receptacle 202. Toothed wheels 203 are keyed to shafts 204 which have gear motors 205 keyed to their other ends for driving the wheels at accurately controllable speeds of rotation. The metallic oxide powder 201 is projected from each of the several wheels 203 against the molten pig iron stream 205 in the form of jets 206 (see FIG. 5), to be absorbed by the molten pig iron stream 205.

It will be understood that the annular receptacle 202 could be replaced by several individual receptacles grouped radially about the stream of molten pig iron 205. Each receptacle would be provided with at least one slot having a dispensing wheel 203. Some of the individual receptacles may dispense say iron oxide, while others may dispense alloying metal powders, such as Ni, Va, Mo, Cr, etc.

However, for industrial applications with a through put of upwards of 100 tons per hour, where the stream of pig iron 205 may be 2" to 3" in diameter, such procedure may not produce a sufficiently homogeneous mixture. It is preferred to provide two or more superposed annular dispensing receptacles, one injecting into stream 205 the required amount of metal oxide powder and the other or others injecting alloying metal powders. One such superposed annular dispensing receptacle is shown at **202*a* in broken lines in FIG. 4**.

The stream of molten metal 205, on its way axially downward, finally hits the rapidly rotating projector 100, axially located in the main chamber of the spray casting apparatus containing the non-oxidizing atmosphere. It is projected by the projector 100 radially of its axis and is deposited upon the inside surface of the heat absorbing target flight 2' to form the continuous metal plate product 1" of unlimited length, substantially as described above and in the above noted parent applicated.

Owing to the rapidity of chilling, the structure of the spray-cast product plate 1" is free of segregations and can be considered as a finished product even without subsequent rolling. The process gives the advantage of producing a plate only, say, ⅜" thick which can be hot rolled without reheating in a three-stand four-high mill to 0.060" which is suitable for subsequent cold rolling to lightest gauges.

Steel made by this process is much cheaper to produce than steel made either by the electric furnace or the LD oxygen process. Both of these processes consume a great deal of energy, either directly or in the form of oxygen. The process of the present invention, on the contrary, starts with a stream of molten pig iron and accomplishes the reduction of carbon content from over 4% to a steel level of less than 1% by injecting into the stream oxygen in the form of iron oxide. No heat is added or consumed. In fact the steel is obtained without the metal ever reaching steel melting temperature which is over 1560° C. Heavy consumption of refractories which is unavoidable with conventional processes is totally absent, the reaction taking place while the iron stream touches no refractories. The only item of equipment involved upstream of the spray casting unit is the one or more pulverulent material dispensing receptacles 202 (and 202*a* if present), which are installed on top of the spray casting unit. The cost of the final operation (i.e. spray casting) is the same whether steel is produced by a conventional process, or by the process and apparatus of the present invention.

Modifications may be made in the invention without departing from the spirit of it.

What is claimed is:

1. A process of converting a stream of desilicized and desulfurized pig iron into a single steel strip of unlimited length comprising the steps of injecting into said pig iron stream a pulverulent oxide chosen from the group consisting of mill scale, iron oxide, the oxide of an alkaline metal which completely evaporates at the temperature of the molten pig iron, the oxide of a desired alloying metal and combinations thereof, providing a heat absorbing target having a cylindrical target surface with a vertical axis, providing a projector axially of said target surface for projecting a stream of molten particles against said target surface, providing a heat absorbing upper horizontal plane above said projecting means and a heat absorbing lower horizontal plane below said projecting means, said upper and lower planes cooperating with said target surface to form a chamber, maintaining a non-oxidizing atmosphere within said chamber, rapidly rotating and vertically oscillating said projector, causing said molten metal stream to flow vertically upon said projector, converting said molten stream by means of said projector into a stream of particles and projecting said stream of particles against said target to deposit on said target surface a layer of metallic particles substantially only one particle deep to insure that all the particles of said layer reach a crystallizing stage before the deposition of another layer thereon, similarly depositing subsequent layers until the strip product of required thicknesses is produced, providing said target surface with a diameter such that at least half of said particles are solid and plastic when they hit said target surface, rotating said target and said strip product formed thereon, and withdrawing said strip product therefrom as a single strip.

2. The process claimed in claim 1 wherein said steel strip comprises low carbon steel and including the step of injecting a quantity of said pulverulent oxide into said molten pig iron stream sufficient to reduce the carbon content thereof to below about 0.2%.

3. The process claimed in claim 1 wherein said steel strip comprises medium carbon steel and including the step of injecting a quantity of said pulverulent oxide into said molten pig iron stream sufficient to reduce the carbon content thereof to from about 0.2% to about 0.5%.

4. The process claimed in claim 1 wherein said steel strip comprises high carbon steel and including the step of injecting a quantity of said pulverulent oxide into said molten pig iron stream sufficient to reduce the carbon content thereof to a value greater than about 0.5%.

5. The process claimed in claim 1 wherein said steel strip comprises alloy steel and including the steps of injecting a quantity of said oxide into said molten pig iron stream to reduce the carbon content thereof to the level of the steel grade desired, injecting into said molten pig iron stream at least one pulverulent alloying metal, and superheating said molten pig iron to compensate for the heat of fusion of said added alloying metal powder.

* * * * *